US012012957B2

(12) United States Patent
Jaeschke et al.

(10) Patent No.: US 12,012,957 B2
(45) Date of Patent: Jun. 18, 2024

(54) SCREW PUMP OR MACHINE WITH A LINER THAT BENDS AND/OR PIVOTS WITH THE ROTORS

(71) Applicant: CIRCOR PUMPS NORTH AMERICA, LLC., Monroe, NC (US)

(72) Inventors: Axel Jaeschke, Monroe, NC (US); Victor Hall, Monroe, NC (US)

(73) Assignee: CIRCOR PUMPS NORTH AMERICA, LLC., Monroe, NC (US)

( * ) Notice: Subject to any disclaimer, the term of this patent is extended or adjusted under 35 U.S.C. 154(b) by 0 days.

(21) Appl. No.: 17/783,893

(22) PCT Filed: Dec. 10, 2019

(86) PCT No.: PCT/US2019/065403

§ 371 (c)(1),
(2) Date: Jun. 9, 2022

(87) PCT Pub. No.: WO2021/118533

PCT Pub. Date: Jun. 17, 2021

(65) Prior Publication Data

US 2023/0013936 A1 Jan. 19, 2023

(51) Int. Cl.

| | |
|---|---|
| ***F04C 15/00*** | (2006.01) |
| ***F01C 21/10*** | (2006.01) |
| ***F04C 2/16*** | (2006.01) |

(52) U.S. Cl.

CPC ..... *F04C 15/0046* (2013.01); *F01C 21/102* (2013.01); *F04C 2/16* (2013.01);
(Continued)

(58) Field of Classification Search

CPC .. F04C 15/0046; F04C 2/16; F04C 2240/601; F04C 2240/802; F04C 2270/17; F01C 21/102

See application file for complete search history.

(56) References Cited

U.S. PATENT DOCUMENTS 2,999,466 A * 9/1961 Hornschuch ..... F04C 2/16 418/153
3,435,772 A 4/1969 Schlect
(Continued)

FOREIGN PATENT DOCUMENTS

DE 2358360 A1 5/1975
DE 202016102499 U1 7/2016
(Continued)

OTHER PUBLICATIONS

Machine Translation of Foreign Patent Publication: DE 102016108640 A1, Inventor: Eschner, Published: Nov. 16, 2017. (Year: 2017).*
(Continued)

*Primary Examiner* — Mary Davis

(74) *Attorney, Agent, or Firm* — KDW Firm PLLC

(57) ABSTRACT

An improved screw pump such as, for example, a twin screw pump is disclosed. In one embodiment, the screw pump includes a casing, first and second intermeshing rotors, and a liner positioned between the first and second rotors and the casing. In use, the liner is arranged and configured to bend and/or pivot in unison with the first and second rotors under the axial hydraulic pressure experienced by the screw pump during use. In one embodiment, the liner may be arranged and configured to include an asymmetric axial stiffness to facilitate bending of the liner. In another embodiment, the liner may be arranged and configured in multiple segments, the segments being arranged and configured to pivot to approximate the bending of the rotor shafts.

17 Claims, 4 Drawing Sheets

(52) U.S. Cl.
CPC .. *F04C 2240/601* (2013.01); *F04C 2240/802* (2013.01); *F04C 2270/17* (2013.01)

(56) References Cited

U.S. PATENT DOCUMENTS

| | | | | |
|---|---|---|---|---|
| 3,667,879 | A | 6/1972 | Cerpelli | |
| 3,857,654 | A | 12/1974 | Streicher | |
| 6,257,839 | B1 * | 7/2001 | Fang | F04C 18/16 417/283 |
| 11,035,338 | B2 * | 6/2021 | Parhar | F04C 2/1075 |
| 2010/0296958 | A1 | 11/2010 | North et al. | |

FOREIGN PATENT DOCUMENTS

| | | | |
|---|---|---|---|
| DE | 10 2016 108640 | A1 | 11/2017 |
| GB | 1379575 | A | 6/1972 |
| GB | 2227057 | B | 1/1993 |
| WO | 2017194508 | A1 | 11/2017 |

OTHER PUBLICATIONS

Machine Translation of Foreign Patent Publication: DE202016102499U1, Applicant: Klaus Union Gmbh & Co KG, Published: Jul. 12, 2016. (Year: 2016).*

Machine Translation of WIPO Publication: WO 2017194508 A1, Inventor: Eschner, Title: Screw Pump, Published: Nov. 16, 2017. (Year: 2017).*

International Search Report and Written Opinion dated Feb. 27, 2020, for the International Patent Application No. PCT/US2019/0654003, filed on Dec. 10, 2019, 6 pages.

EP Extended Search Report dated Nov. 15, 2022 for the EP Patent Application No. 19955411.1, filed on Jun. 21, 2022, 11 pages.

* cited by examiner

SCREW PUMP OR MACHINE WITH A LINER THAT BENDS AND/OR PIVOTS WITH THE ROTORS

FIELD OF THE DISCLOSURE

The present disclosure relates generally to screw pumps or screw machines such as, for example, twin screw pumps, and more particularly to twin screw pumps incorporating a replaceable liner such as, for example, a self-adjusting liner that is arranged and configured to bend and/or pivot to match the bending of the rotor shafts to enable tighter tolerances between the rotors and the liner thereby increasing the overall pump efficiency.

BACKGROUND OF THE DISCLOSURE

Screw pumps such as, for example twin screw pumps, are well-known. In use, screw pumps enable efficient fluid flow from a suction chamber to a pressure chamber. Referring to FIG. 1, as will be readily appreciated by one of ordinary skill in the art, a screw pump 10 such as, for example, a twin screw pump, includes a casing, housing, body, etc. 20 (terms used interchangeably herein without the intent to limit). As illustrated, the casing 20 generally includes an internal chamber 22, one or more inlets 24, and one or more outlets 26. For example, as illustrated, the screw pump 10 may include a center inlet 24 and a center outlet 26. However, while a particular embodiment of a screw pump 10 is illustrated, one of ordinary skill in the art will appreciated that numerous variations are possible. For example, a screw pump may include a side inlet and a top (center) outlet. Alternatively, a screw pump may include a center inlet and a center outlet. Moreover, a screw pump may include a single inlet positioned, for example, in the center, and multiple outlets positioned, for example, at the ends. Alternatively, the pump may include a single outlet and multiple inlets.

In addition, as shown, the screw pump 10 includes at least two, interlocking rotatable screws, rotors, etc. 30 (terms used interchangeably herein without the intent to limit) positioned within the chamber 22 of the casing 20. Each rotor 30 includes at least one threaded-shaped profiling 32. In use, the threaded-shaped profiles 32 formed on a first rotor 30 intermeshes with an adjacent threaded-shaped profile 32 formed on a second rotor 30. Thus, in use, the rotors 30 are arranged and configured to rotate in opposite directions so that fluid entering the inlet 24 (e.g., suction chamber) may be moved axially within the chamber 22 along the longitudinal axes of the rotors 30 until the fluid exits the casing 20 via the outlet 26 (e.g., pressure chamber).

In use, the threaded-shaped profiling 32 formed on the rotors 30 prevent the conveying medium (e.g., liquid) located in one section of the chamber 22 from escaping. In addition, if the pitch and profile of the threaded-shaped profiling 32 is constant, the volume of the individual delivery chambers remains constant in the axial direction. As will be appreciated by one of ordinary skill in the art, screw pumps 10 operate as positive displacement pumps. During rotational movement of the rotors 30, the individual delivery chambers formed between the intermeshing threaded-shape profiles 32 migrate, as it were, in the axial direction from the suction chamber to the pressure chamber and thereby continuously convey the fluid in the chamber 22.

In addition, referring to FIG. 1, the casing 20 includes a replaceable liner 40 that is arranged and configured to surround the rotors 30 (e.g., liner is arranged and configured as a separate component which is installed in the casing). The liner 40 is typically supported and sealed against the inner surfaces of the casing 20. Generally speaking, the efficiency of the screw pump 10 depends, in part, on the tightness of the delivery chambers. In order to increase efficiency of a particular screw pump, the space or gap between the rotors 20 and the liner 40 should be as minimal as possible to prevent backflow (e.g., efficiency of a screw pump depends in large part on the size of the radial gap between the rotors 20 and surrounding surface of the liner 40).

The size of the space or gap between the rotors 20 and the liner 40 depend on a number of variables including, for example, fabrication tolerances. One main driving force of the size of the space or gap between the rotors 20 and the liner 40 is dependent on the amount of shaft bending experienced by the rotors 30 due to the hydraulic forces driven by the differential pressure located in the pump 10 during operation. That is, in use, screw pumps 10 experience differential pressure, which creates hydraulic forces on the rotors 30. This hydraulic force causes the rotors 30 to bend. The higher the expected differential pressure between the suction chamber and the pressure chambers found in a pump 10, the more shaft bending is to be expected. As a result, manufacturers design and configure the liner to accept a certain amount of rotor shaft bending. To accommodate the rotor shaft bending, a space or gap between the outer surface of the rotors 30 and the inner surface of the liner 40 is designed to allow the rotor shaft to bend (e.g., manufacturers design the space or gap to enable the shaft of the rotor 30 to bend while still preventing contact between the rotors 30 and the liner 40). Thus, the greater the expected rotor shaft bending, the greater the space or gap between the rotors 30 and the liner 40. Generally speaking, in one embodiment, the liner 40 includes cutouts, openings, bores, etc. large enough to account for the bending in the rotor shafts, which results in overly large clearances between the rotors 30 and the liner 40, reducing pump efficiency (with the larger spaces or gap, differential pressure causes the pumped fluid to move backwards through the spaces or gaps between the rotors 30 and the liner 40, the bigger the spaces or gaps, the more backflow or slippage can occur, thereby reducing the effective pump capacity and reducing the pump efficiency). Generally speaking, a liner bore may be formed as a fully, rounded bore. In some embodiments however, the bore is eccentrically extended to create an elliptical shape, which can enable bending of the rotor shafts.

The object of the invention is therefore to provide a screw pump that overcomes the disadvantages described.

SUMMARY OF THE DISCLOSURE

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

An improved screw pump is disclosed. As will be shown and described herein, the present disclosure is directed to one or more aspects or features to improve the operation of, for example, a screw pump. However, the aspects or features disclosed herein have applicability outside of screw pumps. For example, the aspects or features of the present disclosure may be used in a hydraulic motor. As such, the term screw pump should be construed broadly to include any screw machine including, for example, hydraulic motors.

In one embodiment, the screw pump includes a liner that is arranged and configured to provide active gap control. That is, in one embodiment, the liner is arranged and configured to bend, pivot, etc., or a combination thereof, along with, in unison with, etc. the rotors. For example, in one embodiment, utilizing the axial forces created by the differential pressure experienced by the screw pump during use, the liner is arranged and configured to bend and/or pivot to follow the bending of the rotors more accurately enabling smaller spaces or gaps between the rotor and the liner.

In one embodiment, the liner is arranged and configured to bend and/or pivot in unison, or substantially therewith, with the rotors. By arranging and configuring the liner to bend and/or pivot with the rotors to approximate the same amount of movement, the space or gap between the outer surface of the rotors and the inner surface of the liner can be reduced (e.g., the space or gap provided between the rotors and the liner need not be designed to accommodate, compensate for, etc. the bending of the rotors since the liner bends and/or pivots in unison with the rotors). As a result, a smaller gap can be provided, which reduces internal slippage and improves pump efficiency.

In one embodiment, the differential pressure experienced between the suction chamber and the pressure chambers found in the casing of the screw pump, can be transferred to the liner to apply unbalanced hydraulic forces onto the liner in a way that the resulting forces cause the liner to bend and/or pivot in unison with the rotor shaft bending. Thus arranged, by enabling the liner to bend and/or pivot in unison with the rotors, a smaller gap between the outer surface of the rotor and the inner surface of the liner can be provided, thereby reducing slippage, which increases pump capacity and pump efficiency.

In one embodiment, the screw pump comprises a casing including a chamber, first and second rotors rotatably positioned within the chamber of the casing, the first and second rotors including intermeshing threaded-shape profiling, and a liner positioned between the casing and the first and second rotors. The liner is arranged and configured to bend and/or pivot under axial forces experienced during pump operation so that the liner approximates bending of the first and second rotors during operation.

In one embodiment, the liner is arranged and configured to bend and/or rotate in unison with the first and second rotors.

In one embodiment, the liner is arranged and configured to bend and/or rotate in same direction and amount as the first and second rotors.

In one embodiment, the liner is arranged and configured to be asymmetrical in an axial direction thereof.

In one embodiment, the liner includes a first segment, a second segment, and an intermediate coupling mechanism positioned between the first and second segments, the coupling mechanism being arranged and configured to induce an asymmetric stiffness between the first and second segments.

In one embodiment, the coupling mechanism is a center segment extending between the first and second segments, the central segment including an elasticity and/or stiffness arranged and configured to enable the first and second segments to bend relative to each other.

In one embodiment, the coupling mechanism is a bridge segment extending between the first and second segments, the bridge segment being arranged and configured to enable the first and second segments to bend relative to each other.

In one embodiment, the coupling mechanism extends between the first and second segments along a top portion thereof thereby creating an asymmetrical coupling between the first and second segments.

In one embodiment, the coupling mechanism includes one or more springs positioned between the first and second segments.

In one embodiment, the one or more springs include a first spring having a first spring constant and a second spring including a second spring constant, the second spring constant being different from the first spring constant to create the asymmetric axial stiffness.

In one embodiment, the one or more springs include a first spring and a second spring, the first and second springs being asymmetrically positioned between the first and second segments to create the asymmetric stiffness.

In one embodiment, the liner includes a first segment and a second segment, the first and second segments being arranged and configured to pivot relative to each other.

In one embodiment, the screw pump further comprises one or more spring members positioned between an outer surface of the liner and an inner surface of the casing, the springs being arranged and configured to bend and/or pivot the liner under axial forces experienced during pump operation so that the liner approximates bending of the first and second rotors during operation.

In one embodiment, the screw pump further comprises an active external control system for selectively supplying force to the liner to cause the liner to bend and/or pivot.

In one embodiment, the active control system includes a hydraulic cylinder arranged and configured to actively adjust the position of the liner.

BRIEF DESCRIPTION OF THE DRAWINGS

By way of example, a specific embodiment of the disclosed device will now be described, with reference to the accompanying drawings, in which.

Figure 1:
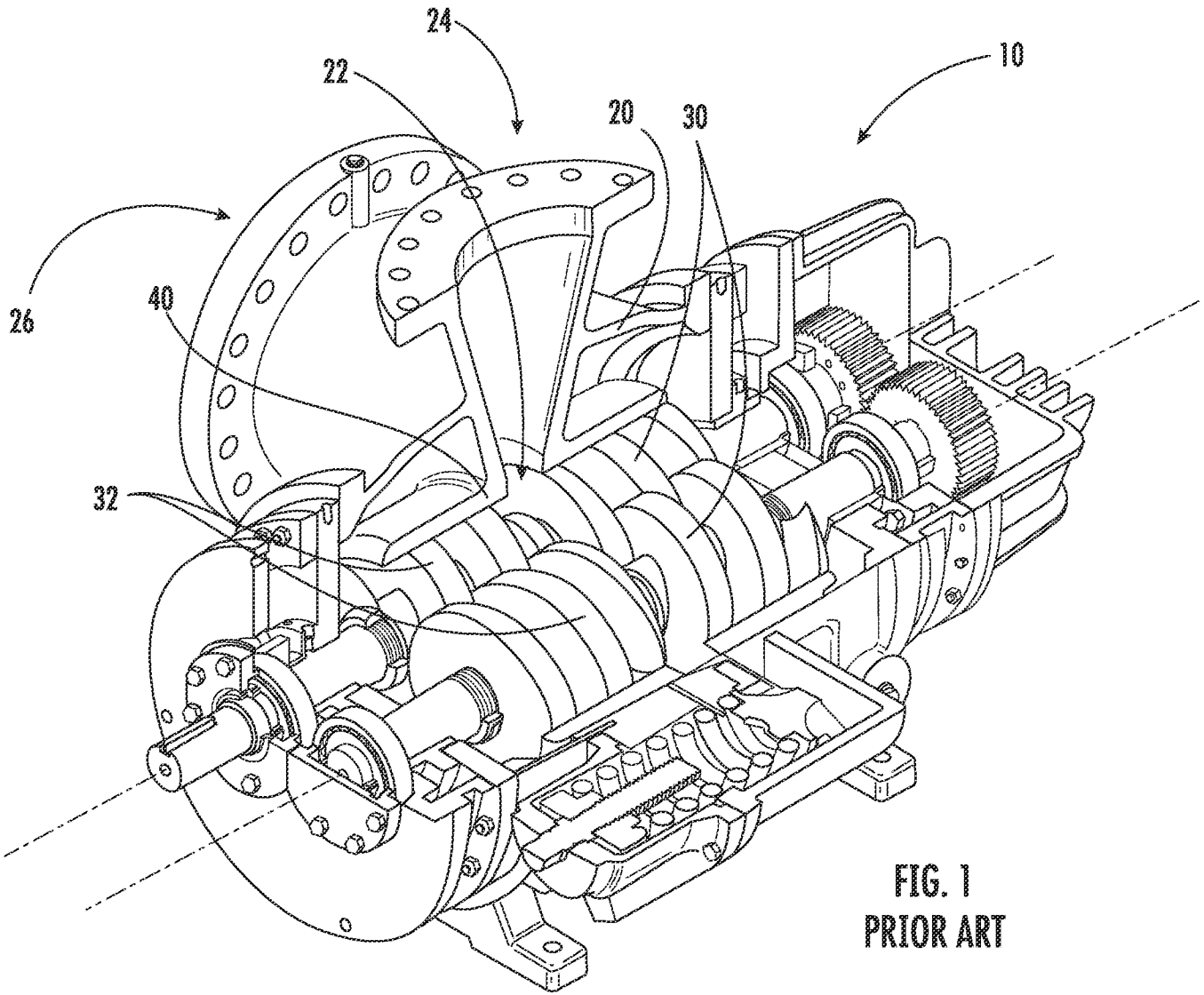
FIG. 1 PRIOR ART
FIG. 1 is a perspective view of a known screw pump, the pump's casing show partially removed to illustrate internal components of the screw pump.

The drawings are not necessarily to scale. The drawings are merely representations, not intended to portray specific parameters of the disclosure. The drawings are intended to depict example embodiments of the disclosure, and therefore are not be considered as limiting in scope. In the drawings, like numbering represents like elements.

DETAILED DESCRIPTION

Numerous embodiments of improved screw pumps in accordance with the present disclosure will now be described more fully hereinafter with reference to the accompanying drawings, in which preferred embodiments of the present disclosure are presented. The screw pump of the present disclosure may, however, be embodied in many different forms and should not be construed as being limited to the embodiments set forth herein. Rather, these embodiments are provided so that this disclosure will convey certain example aspects of the screw pump to those skilled in the art. In the drawings, like numbers refer to like elements throughout unless otherwise noted.

As will be described in greater detail below, in various embodiments, a screw pump such as, for example, a twin screw pump, according to the present disclosure includes a casing, one or more rotors, and a replaceable liner positioned between the casing and the one or more rotors. As will be appreciated by one of ordinary skill in the art, the casing may include various components such as, for example, one or more cover plates. For sake of brevity, as used herein, casing includes the main body and associated components coupled thereto such as the casing cover plates. As will also be appreciated by one of ordinary skill in the art, a liner can be manufactured as a single unitary component or may be manufactured from multiple components coupled together.

In accordance with one aspect of the present disclosure, in one embodiment, the liner is arranged and configure to bend and/or pivot (e.g., rotate) to approximate the bending of the shaft of the rotors (e.g., the liner is arranged and configured to bend and/or pivot at approximately the same amount and in the same direction as the rotors). Thus arranged, as will be described in greater detail, the gap between the rotors and the liner can be minimized to prevent backflow thereby increasing the operating efficiency of the screw pump. In one embodiment, the hydraulic forces which cause the shaft of the rotor to bend can be utilized to bend and/or pivot the liner to approximately the same amount and in the same direction.

As will be described herein, the features according to the present disclosure may be used with any suitable screw pump now known or hereafter developed. As such, details regarding construction and operation of the screw pump are omitted for sake of brevity of the present disclosure. In this regard, the present disclosure should not be limited to the details of the screw pump disclosed and illustrated herein unless specifically claimed and that any suitable screw pump can be used in connection with the principles of the present disclosure.

Referring to FIG. 1, and as previously mentioned, screw pumps 10 such as, for example twin screw pumps, are used to move fluid from a suction chamber to a pressure chamber. In use, screw pumps 10 include, inter alia, a casing 20 having an internal chamber 22, an inlet 24, and an outlet 26. As shown in the embodiment of FIG. 1, the screw pump 10 includes two, interlocking rotatable rotors 30 positioned within the chamber 22 of the casing 20. Each rotor 30 includes at least one threaded-shaped profiling 32, although as illustrated, each rotor 30 may include more than one threaded-shape profile. In use, the threaded-shaped profiles 32 formed on a first rotor 30 intermeshes with an adjacent threaded-shaped profile 32 formed on a second rotor 30. In use, the rotors 30 are arranged and configured to rotate in opposite directions so that fluid entering the inlet 24 (e.g., suction chamber) may be moved axially within the chamber 22 along the longitudinal axes of the rotors 30 until the fluid exits the casing 20 via the outlet 26 (e.g., pressure chamber).

As shown in the embodiment of FIG. 1, the casing 20 also includes a liner 40 that is arranged and configured to surround the rotors 30. The liner 40 is typically supported and sealed against the inner surfaces of the casing 20. In one embodiment, the liner 40 is replaceable (e.g., liner is arranged and configured as a separate component which is installed in the casing).

Generally speaking, and as previously mentioned, in use, screw pumps 10 experience differential pressure between the suction chamber and the pressure chambers found in the screw pump, which creates hydraulic forces on the rotors 30, which causes the rotors 30 to bend. To compensate for such bending, manufacturers provide an enlarged gap between the outer surface of the rotors 30 and the inner surface of the liner 40. However, this enlarged gap increases backflow and decreases pump efficiency.

In accordance with one aspect of the present disclosure, a new and improved liner may be arranged and configured to bend and/or pivot (i.e., rotate) along with, in unison with, etc. the rotors 30. Thus arranged, by enabling the liner to bend and/or pivot with the rotors 30, a smaller consistent gap can be provided between the outer surface of the rotors 30 and the inner surface of the liner thereby decreasing backflow and increasing efficiency.

In use, the liner may be arranged and configured to bend and/or pivot along with, in unison with, etc. the rotors 30 by any suitable mechanism now known or hereafter developed. In one preferred embodiment, in accordance with one or more aspects of the present disclosure, the bending of the liner can be induced by using the hydraulic differential pressure experienced by the pump during operation. That is, as will be appreciated by one of ordinary skill in the art, during use, the liner is exposed to suction pressure in certain areas and to discharge pressure in other areas. However, during use, the pressure is symmetrically distributed about the liner both radially and axially. In conventional pumps, the liner is axial symmetrical (e.g., known liners are built with a symmetric stiffness in the axial direction of the liner (i.e., parallel to longitudinal axis of the rotors)).

In accordance with one aspect of the present disclosure, the liner is arranged and configured to be asymmetrical in the axial direction. By arranging and configuring the liner asymmetric (e.g., by arranging the liner with an asymmetric stiffness in the axial direction), the axial hydraulic forces acting on the liner during pump operation will cause the liner to deform, bend, move, or the like, along the plane of the rotor axis (e.g., the horizontal plane). By designing the asymmetric stiffness based on the expected hydraulic forces, one can arrange and configure the liner to bend along with, in unison with, etc. the rotors.

In accordance with one aspect of the present disclosure, the liner of the present disclosure may be arranged and configured with an asymmetric stiffness by any suitable mechanism now known or hereafter developed. For example, referring to FIG. 2, an example of an embodiment of a liner 140 having an asymmetric stiffness is shown.

Figure 2:
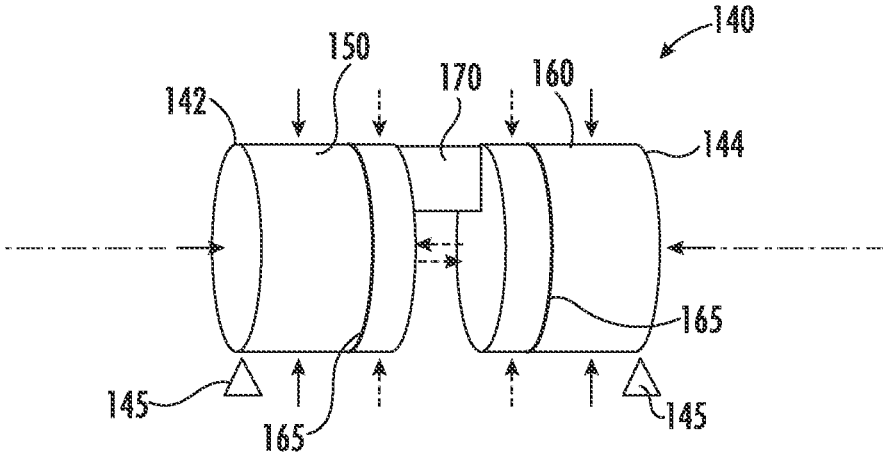
FIG. 2 is a schematic representation of an example of an embodiment of a liner that may be used in the screw pump shown in FIG. 1 in accordance with one aspect of the present disclosure.

As schematically represented in FIG. 2, the liner 140 includes a first end 142 and a second end 144. In use, the liner 140 may be supported at both the first and second ends 142, 144 (e.g., the liner 140 can be supported inside of the casing 20 on or along the outer edges of the liner 140). The first and second ends 142, 144 of the liner 140 may be supported within the casing 20 of the screw pump 10 by any suitable mechanism now known or hereafter developed including, for example, first and second bearings 145 positioned at the first and second ends 142, 144, respectively. In use, the liner 140 supports are positioned adjacent to, in proximity with, close to, etc. the bearing position of the rotor shafts. The stiffness of the connection being designed and configured to bend in a way, that the resulting overall liner movement will follow the shaft bending.

As schematically represented, in one embodiment, the liner 140 includes a first segment 150 and a second segment 160, the first and second segments 150, 160 may be coupled to each other. The first and second segments may be coupled to each other by any suitable mechanism now known or hereafter developed. For example, as schematically represented, the first and second segments 150, 160 may be coupled to each other via a coupling mechanism 170, although a single coupling mechanism 170 is shown in the embodiment illustrated in FIG. 2, as will be appreciated by one of ordinary skill in the art, the first and second segments 150, 160 may be coupled by two or more coupling mechanisms. In use, the coupling mechanisms 170 are arranged and configured to enable the liner 140 to bend and/or pivot to approximate the bending of the rotor shafts.

In one embodiment, each of the coupling mechanisms 170 may be in the form of one or more ribs, bolts, brackets, etc. Moreover, while the FIGS. generally show individual pieces positioned between the first and second segments 150, 160 of the liner 140, it is envisioned that a continuous center segment arranged and configured to bend can be utilized. That is, for example, in one embodiment, the first and second segments 150, 160 may be coupled by a central segment extending entirely between the first and second segments 150, 160 (e.g., central segment may completely fill the space between the first and second segments 150, 160). In use, the central segment may be arranged and configured with an elasticity and/or stiffness arranged and configured to enable the first and second segments 150, 160 to bend relative to each other. Alternatively, the first and second segments 150, 160 may be coupled by a bridge segment positioned therebetween. The thinned bridged segment may be positioned between the first and second segments 150, 160 (e.g., bridge segment may only partially fill the space between the first and second segments 150, 160). In use the bridge segment may be positioned and/or arranged to enable the first and second segments 150, 160 to bend relative to each other. In either event, the central or bridge segment may be arranged and configured with a differing elasticity compared to the first and second segments 150, 160 to facilitate bending of the first and second segments 150, 160. In addition, why the first and second segments 150, 160 are represented as having a generally cylindric shape, the segments may have other suitable shapes. In addition, as illustrated, the segments 150, 160 may include one or more O-rings 165 to compensate for liner movement.

In accordance with one aspect of the present disclosure, and contrary to known prior-art devices, the first and second segments 150, 160 of the liner 140 may be coupled to each other asymmetrically. For example, referring to FIG. 2, in one embodiment, the first and second segments 150, 160 may be coupled to each other via one or more coupling mechanisms 170 along a top portion thereof but not along a bottom portion thereof. Thus arranged, an asymmetry is introduced in the axial direction of the liner 140 (e.g., the liner is asymmetric along a longitudinal axis thereof). Thus arranged, due to the asymmetrical connection, the liner 140 is arranged and configured to bend. In the illustrated embodiment of FIG. 2, the liner 140 is, generally speaking, axially stiff. However, the liner 140 is permitted to bend due to the axial forces around the bending element (e.g., coupling mechanism 170).

In use, the asymmetrical connection is designed and configured to support the total forces acting on the liner 140 (e.g., the asymmetrical connection is designed to support the total axial force on the liner plus the torque from the resulting forces on the axial surface of the liner multiplied by the action centre of the surface).

Alternatively, in another example of an embodiment, the elasticity and/or stiffness of the liner can be adjusted to enable the liner to bend. For example, in one embodiment, bores may be provided in the liner at, for example, the area at the bottom of the liner. Consequently, in use, the differential pressure would tend to bend the liner.

Figure 3:
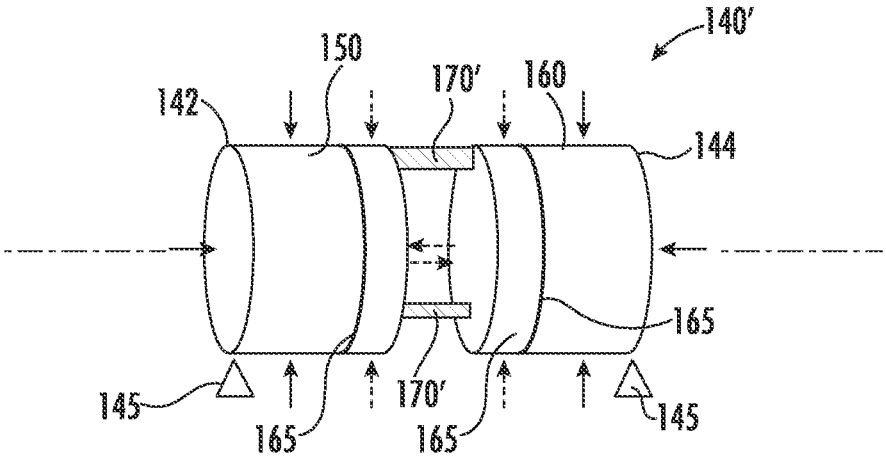
FIG. 3 is a schematic representation of an alternate example of an embodiment of a liner that may be used in the screw pump shown in FIG. 1 in accordance with one aspect of the present disclosure.

Alternatively, referring to FIG. 3, in another example of an embodiment, the liner 140' may be arranged and configured asymmetrically in the axial direction by utilizing one or more spring-like elements distributed asymmetrically between the first and second segments 150, 160 (e.g., the coupling mechanism may be in the form of one or more springs 170'). In use, the asymmetrical expansion of the springs 170' will cause asymmetrical displacement of the two segments 150, 150 of the liner 140'. By properly selecting spring-like elements 170', the liner 140' can be arranged and configured to bend to approximate the rotor shaft bending. For example, in use, some springs 170' will extend more than others, have different spring constants, etc. By properly selecting springs 170' and positioning them between the first and second segments 150, 160, asymmetrical bending can be introduced into the liner 140'. In the illustrated embodiment of FIG. 3, the liner 140' is permitted to bend due to the different axial stiffnesses provided by the coupling mechanisms 170' (e.g., springs). In use, the springs will axially deform differently caused by the axial forces acting on the liner (e.g., different axial deformation of the springs will cause the liner to bend as required).

For example, in one embodiment, a spring 170' having a predetermined stiffness can be provided in-between the first and second segments 150, 160 along a top portion thereof. By properly selecting the stiffness of the spring 170', during use, the liner 140' can bend in unison with, along with, etc. the rotor 30 when subject to radial forces. Alternatively, in one embodiment, two or more axial springs 170' can be provided in-between the first and second segments 150, 160. In use, the axial springs 170' may be positioned asymmetrical and/or be provided with differing stiffnesses so that radial forces will cause unequal bending of the liner 140' when subject to radial forces. By properly selecting the stiffnesses of the springs 170' and/or by selectively, circumferentially positioning the springs between the first and second segments 150, 160, during use, the liner 140' can bend to approximate the rotor shaft bending when subject to radial forces. Alternatively, in one embodiment, it is envisioned that shape-memory material may be used in place of springs.

Alternatively, in another embodiment, a plurality of springs may be positioned on the outside of the liner (e.g., springs may be positioned between the casing and the liner) rather than between the first and second segments. In one embodiment, weaker springs may be utilized along the bottom of the liner and stronger springs may be utilized along the top portion of the liner. Thus arranged, during use, the liner can be made to tilt downwards approximately the downward bending of the rotor.

Figure 4:
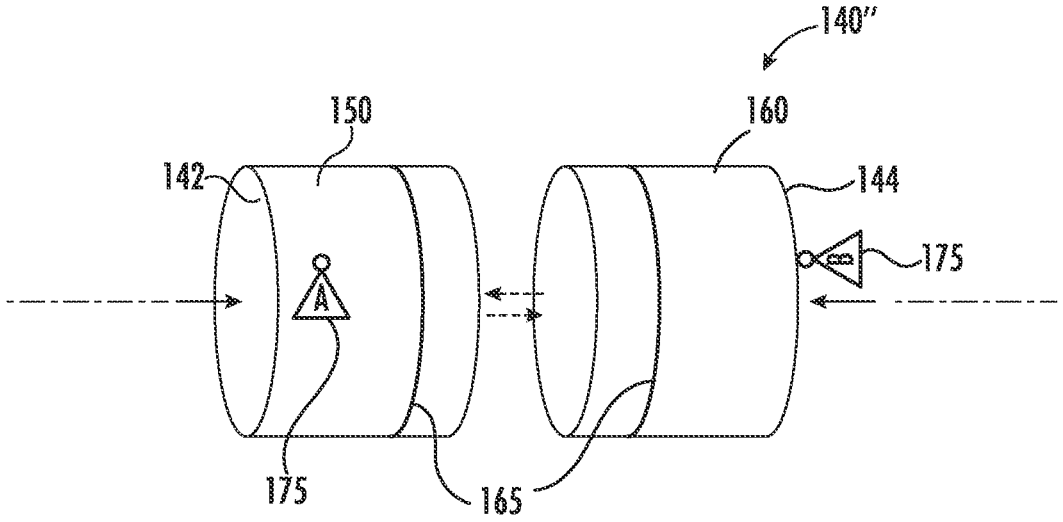
FIG. 4 is a schematic representation of an alternate example of an embodiment of a liner that may be used in the screw pump shown in FIG. 1 in accordance with one aspect of the present disclosure.

Alternatively, referring to FIG. 4, in another example of an embodiment, the liner 140" may be arranged and configured to rotate, pivot, tilt, etc. (terms used interchangeably herein without the intent to limit). That is, for example, the first and second segments 150, 160 of the liner 140" may each be associated with one or more pivot-points 175 so that each of the first and second segments 150, 160 may be arranged and configured to pivot about the one or more pivot points 175. Thus arranged, the first and second segments 150, 160 of the liner 140" can pivot to approximate the bending of the rotor shafts. For example, in one embodiment, a center segment may be positioned between first and second segments 150, 160. In use, the center segment may be arranged and configured from a different material and/or stiffness. The first and second segments 150, 160 may each be provided with a pin 175 so that the first and second segments 150, 160 can pivot about its respective pin 175. In use, the pins 175 can be positioned along any point along the length of the liner segments 150, 160. Consequently, in use, each liner segment 150, 160 can pivot due to the hydraulic forces experienced during pump operation.

In use, the pivot-points 175 may be any suitable pivot-points now known or hereafter developed to enable the segments 150, 160 of the liner 140" to pivot under the forces experienced by the pump during use. For example, in one embodiment, pins having eccentric diameters may be positioned in casing and the liner to adjust the radial positioning of the liner. In one embodiment, the pivot-points may be positioned between the liner and the casing. Alternatively, the pivot-points may be positioned between the liner and a cover plate. In one embodiment, the pivot-points 175 can be in the form of one or more torsional/bending flexible elements. For example, the pivot-points 175 can include a spring and dampening-characteristic either as part of the pivot-point 175 or as a separate element associated therewith. The pivot-pins 175 may be positioned between the liner segments or liner and the casing. In one embodiment, the O-rings 165 can act as the spring/dampening devices.

In addition, and/or alternatively, in one embodiment, the liner may be arranged and configured to bend and pivot so that the liner can approximate the bending of the rotor shaft.

Figure 5A:
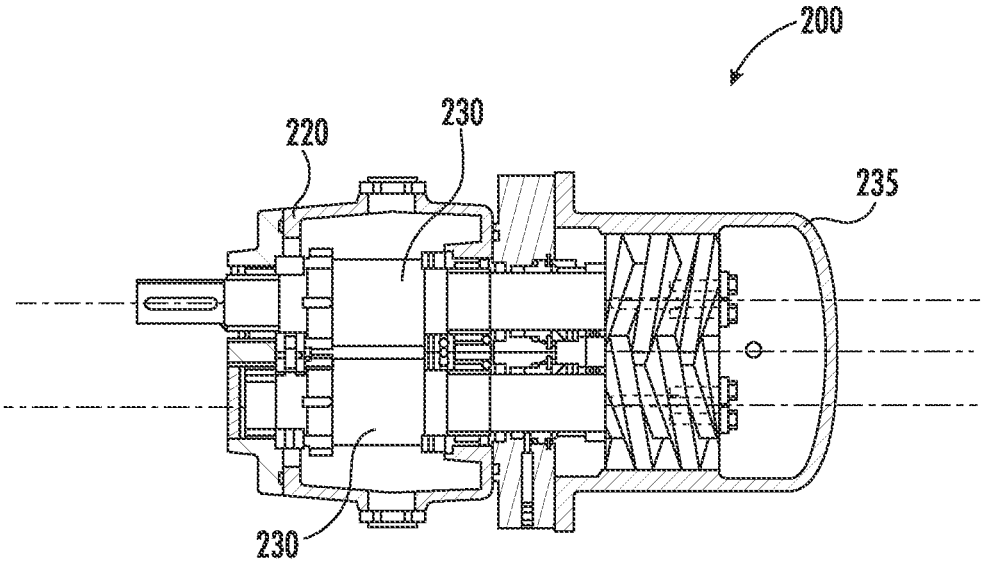
FIG. 5A PRIOR ART
FIG. 5A is a cross-section view of an alternate embodiment of a known screw pump.
Figure 5B:
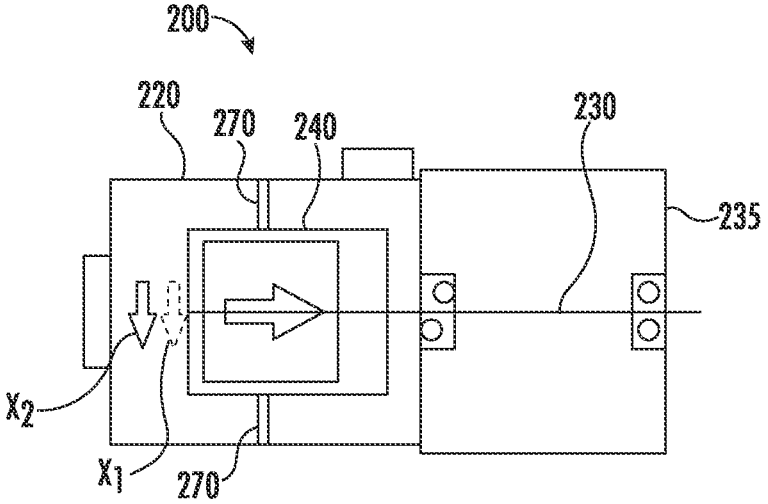
FIG. 5B is a schematic representation of an example of an embodiment of a liner that may be used in the screw pump shown in FIG. 5 in accordance with one aspect of the present disclosure.

Referring to FIG. 5A, a screw pump 200 may be arranged and configured with a single set of rotors 230 in, for example, an overhang design. In an overhang designed screw pump 200, a bearing housing 235 may be coupled to the casing 220. The rotor shafts 230 extending into the bearing housing 235. As schematically illustrated in FIG. 5B, in accordance with one aspect of the present disclosure, the rotors 230 in an overhang design screw pump 200 may be arranged and configured by installing adjustable coupling mechanisms 270 such as, for example, variable springs, in between the casing 220 of the screw pump 200 and the liner 240 of the screw pump 200. Thus arranged, the axial forces acting on the screw pump 200 during operation would cause the springs 270 to deform asymmetrically causing the liner 240 to bend and/or pivot in unison with the rotor shafts 230. As illustrated, the liner 240 flexs (e.g., pivots and/or bends) so that the bending/pivoting direction $X_1$ and movement of the liner 240 is in the same direction and substantially equivalent to the bending direction $X_2$ and movement of the rotor shafts 230 outside of the bearing housing 235.

In addition, in some embodiments, in accordance with one aspect of the present disclosure, the screw pump may further include an active or artificial control system for selectively supplying axial forces to the liner as required. That is, for example, in some embodiments, the screw pump may be operatively coupled to an external control system that is arranged and configured to supply active forces on the liner and/or coupling elements (e.g., springs) to cause the liner to flex (e.g., bend and/pivot). That is, in contrast to or in combination with, the forces created during pump operation, the screw pump may include an external, artificial control system arranged and configured to supply force to the liner and/or coupling elements (e.g., springs) so that the liner bends and/or pivots in unison with the rotor shafts. For example, in one embodiment, the external control system may be arranged and configured to supply force to the coupling elements to bend and/or pivot the liner. In one embodiment, for example, a hydraulic cylinder could be positioned in parallel with the coupling elements (e.g., spring elements) to actively force the spring elements to deform as required. Alternatively, in one embodiment, one or more coupling elements could be replaced by a hydraulic cylinder or similar device.

In addition, and/or alternatively, bending and positioning control could be accomplished via length controlling elements, which could be adjusted via, for example, an external control system (e.g., hydraulic cylinders, etc.). These devices can be, for example, either installed in parallel or without spring-elements within the liner or in parallel to the pivoting points between liner segments and casing.

In accordance with the principles of the present disclosure, the liner is arranged and configured to bend and/or pivot to follow the approximate bending of the rotor shaft (e.g., the liner can be made to bend and/or pivot to the same degree and same direction as the rotor shafts). In addition, in one embodiment, the hydraulic forces experienced by the screw pump, which cause the rotor shaft to bend can also be used to bend and/or pivot the liner so that the liner bends and/or pivots parallel to the rotor shaft to approximate the bending of the rotor shaft. For example, as described herein, the liner may be arranged and configured with an asymmetrical axial stiffness so that the liner can bend under the forces created by the differential pressures experience during pump operation. Alternatively, and/or in addition, segments of the liner may be arranged and configured to pivot relative to each other so that the liner can pivot under the forces created by the differential pressures experience during pump operation. Thus arranged, the gap between the outer surface of the rotor and the inner surface of the liner can be minimized thereby decreasing backflow and increasing pump efficiency.

In accordance with one or more aspects of the present disclosure, numerous advantages are attainable. For example, it is expected that the gap between the rotor and the liner can be reduced to approximately 0.01 mm to 1 mm, depending on pump size and application. In addition, the casing of the screw pump need not be modified to receive the liner. In one embodiment, slippage reduction on the order of approximately 50% can be expected.

Although one example of an embodiment of a screw pump is illustrated in FIG. 1, as will be readily appreciated by one of ordinary skill, the size, shape, configuration, etc. of screw pumps come in many different embodiment. For example, the screw pump may be in the form of a dual flow pump, a single flow pump, etc. As such, the present disclosure should not be limited to the particular embodiment shown and described.

While the present disclosure refers to certain embodiments, numerous modifications, alterations, and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof. The discussion of any embodiment is meant only to be explanatory and is not intended to suggest that the scope of the disclosure, including the claims, is limited to these embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

The phrases "at least one", "one or more", and "and/or", as used herein, are open-ended expressions that are both conjunctive and disjunctive in operation. The terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., engaged, attached, coupled, connected, and joined) are to be construed broadly and may include intermediate members between a collection of elements and relative to movement between elements unless otherwise indicated. As such, connection references do not necessarily infer that two elements are directly connected and in fixed relation to each other. All rotational references describe relative movement between the various elements. Identification references (e.g., primary, secondary, first, second, third, fourth, etc.) are not intended to connote importance or priority but are used to distinguish one feature from another. The drawings are for purposes of illustration only and the dimensions, positions, order and relative to sizes reflected in the drawings attached hereto may vary.

What is claimed is:

1. A screw pump comprising:

a casing including a chamber;

first and second rotors rotatably positioned within the chamber of the casing, the first and second rotors including intermeshing threaded-shape profiling; and a liner positioned between the casing and the first and second rotors;

wherein the liner includes a first segment and a second segment, the first and second segments being arranged and configured to pivot relative to each other;

wherein the liner is arranged and configured to bend and/or pivot under axial forces experienced during pump operation so that the liner approximates bending of the first and second rotors during operation;

wherein the liner includes an intermediate coupling mechanism positioned between the first and second segments, the coupling mechanism being arranged and configured to induce an asymmetric stiffness between the first and second segments; and wherein the coupling mechanism includes at least one spring positioned between the first and second segments.

2. The screw pump of claim 1, wherein the liner is arranged and configured to bend and/or rotate in unison with the first and second rotors.

3. The screw pump of claim 1, wherein the liner is arranged and configured to bend and/or rotate in same direction and amount as the first and second rotors.

4. The screw pump of claim 1, wherein the liner is arranged and configured to be asymmetrical in an axial direction thereof.

5. The screw pump of claim 1, wherein the coupling mechanism is a center segment extending between the first and second segments, the central segment including an elasticity and/or stiffness arranged and configured to enable the first and second segments to bend relative to each other.

6. The screw pump of claim 1, wherein the coupling mechanism is a bridge segment extending between the first and second segments, the bridge segment being arranged and configured to enable the first and second segments to bend relative to each other.

7. The screw pump of claim 1, wherein the coupling mechanism extends between the first and second segments along a top portion thereof thereby creating an asymmetrical coupling between the first and second segments.

8. The screw pump of claim 1, wherein the at least one spring one or more springs include a first spring having a first spring constant and a second spring including a second spring constant, the second spring constant being different from the first spring constant to create the asymmetric axial stiffness.

9. The screw pump of claim 1, wherein the at least one spring include a first spring and a second spring, the first and second springs being asymmetrically positioned between the first and second segments to create the asymmetric stiffness.

10. The screw pump of claim 1, further comprising one or more spring members positioned between an outer surface of the liner and an inner surface of the casing, the springs being arranged and configured to bend and/or pivot the liner under axial forces experienced during pump operation so that the liner approximates bending of the first and second rotors during operation.

11. The screw pump of claim 1, further comprising an active external control system for selectively supplying force to the liner to cause the liner to bend and/or pivot.

12. The screw pump of claim 11, wherein the active control system includes a hydraulic cylinder arranged and configured to actively adjust the position of the liner.

13. A screw pump comprising:

a casing including a chamber;

first and second rotors rotatably positioned within the chamber of the casing, the first and second rotors including intermeshing threaded-shape profiling; and a liner positioned between the casing and the first and second rotors;

wherein the liner includes a first segment, a second segment, and an intermediate coupling mechanism positioned between the first and second segments, the coupling mechanism being arranged and configured to induce an asymmetric stiffness between the first and second segments;

wherein the liner is arranged and configured to bend and/or pivot under axial forces experienced during pump operation so that the liner approximates bending of the first and second rotors during operation.

14. The screw pump of claim 13, wherein the coupling mechanism is a center segment extending between the first and second segments, the central segment including an elasticity and/or stiffness arranged and configured to enable the first and second segments to bend relative to each other.

15. The screw pump of claim 13, wherein the coupling mechanism is a bridge segment extending between the first and second segments, the bridge segment being arranged and configured to enable the first and second segments to bend relative to each other.

16. The screw pump of claim 13, wherein the coupling mechanism extends between the first and second segments along a top portion thereof thereby creating an asymmetrical coupling between the first and second segments.

17. The screw pump of claim 13, wherein the coupling mechanism includes one or more springs positioned between the first and second segments.

* * * * *